United States Patent [19]

Omura

[11] Patent Number: 4,589,515

[45] Date of Patent: May 20, 1986

[54] EXHAUST TAIL PIPE ARRANGEMENT

[75] Inventor: Hideo Omura, Yokosuka, Japan

[73] Assignee: Nissan Motor Company, Limited, Yokohama, Japan

[21] Appl. No.: 679,247

[22] Filed: Dec. 7, 1984

[30] Foreign Application Priority Data

Feb. 8, 1984 [JP] Japan ..... 59-16166[U]

[51] Int. Cl.[4] ..... F01N 7/08

[52] U.S. Cl. ..... 181/227

[58] Field of Search ..... 181/227, 247-250

[56] References Cited

U.S. PATENT DOCUMENTS 3,752,260 8/1973 Heath ..... 181/249 X

OTHER PUBLICATIONS

Abstract of Periodical Service Manual, No. 442 of Nissan Motor Co., Ltd., issued Aug. 1981.

*Primary Examiner*—Benjamin R. Fuller

*Attorney, Agent, or Firm*—Schwartz, Jeffery, Schwaab, Mack, Blumenthal & Evans

[57] ABSTRACT

An exhaust tail pipe of an engine is covered at its end section with an outer cover member leaving therebetween a space communicated with ambient air. Many perforations are formed in the tail pipe end section to allow the inside of the tail pipe end section to communicate with the space. Each perforation has a diameter d (mm) within a range expressed by the following formula:

$$d \leqq \frac{4.4}{C} \times 10^3 \frac{A}{D^2}$$

where A(l)=the displacement of the engine; D(mm)=the inner diameter of the exhaust tail pipe end section; and C=the kind of stroke cycle of the engine, thereby allowing a part of exhaust gas flowing through the tail pipe end section to dissipate to the space through the perforations.

9 Claims, 8 Drawing Figures

EXHAUST TAIL PIPE ARRANGEMENT

BACKGROUND OF THE INVENTION

1. Field of the Invention

This invention relates to an exhaust system of an automotive engine or the like, and more particularly to an exhaust tail pipe arrangement for the purpose of exhaust noise reduction.

2. Background

In general, an exhaust system of an automotive engine or the like consists of an exhaust pipe disposed under the floor of a vehicle body and extends from the engine to the rear end section of the vehicle body. Additionally, a catalytic converter, a muffler and the like are disposed in the exhaust pipe. The extreme end section of the tail pipe forms a tail pipe through which exhaust gas from the engine is discharged to ambient air. Drawbacks are encountered in such a conventional exhaust pipe arrangement in which the boundary layer of exhaust gas flow is grown on the inner surface of the tail pipe when exhaust gas from the engine flows through the exhaust pipe at high speeds to be discharged from the open end of the tail pipe. The thus grown boundary layer separates from the tail tube inner surface in the vicinity of the tail tube open end, thereby generating high frequency air flow noise.

SUMMARY OF THE INVENTION

An exhaust tail pipe arrangement of the present invention consists of an exhaust tail pipe having an end section through which exhaust gas from an engine is discharged to ambient air. An outer cover member is disposed around the tail pipe end section in a manner to form a space between it and the exhaust tail pipe and section. Many perforations are formed in the tail pipe end section so that the inside of the tail pipe end section is in communication with the space. Each perforation has a diameter d (mm) expressed by the following formula:

$$d \leqq \frac{4.4}{C} \times 10^3 \frac{A}{D^2}$$

where

A (l)=the displacement of the engine;

D (mm)=the inner diameter of the exhaust tail pipe end section; and

C=the kind of stroke cycle of the engine.

Accordingly, growth of the boundary layer of exhaust gas flow can be effectively suppressed by dissipating a part of the flowing exhaust gas through the perforations, thereby achieving reduction of exhaust noise due to separation of growth boundary layer from the tail pipe inner surface. Additionally, air flow noise to be newly generated due to existence of the perforations can be also be prevented by setting the perforation diameter within an above-mentioned predetermined range, thus achieving total reduction of exhaust noise.

BRIEF DESCRIPTION OF THE DRAWINGS

The features and advantages of the exhaust tail pipe arrangement of the present invention will be more appreciated from the following description taken in conjunction with the accompanying drawings in which like reference numerals designate corresponding parts and elements, in which.

DETAILED DESCRIPTION OF THE INVENTION

Figure 1:
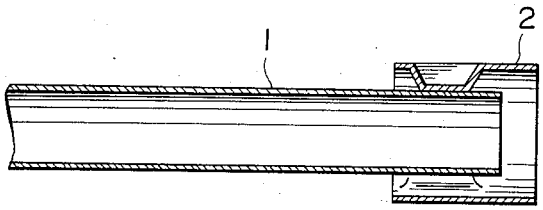
FIG.1 (PRIOR ART)
FIG. 1 is a longitudinal sectional view of a conventional exhaust tail pipe arrangement.

To facilitate the present invention, a brief reference will be made to a conventional exhaust tail pipe arrangement of an exhaust system of an internal combustion engine, depicted in FIG. 1. Referring to FIG. 1, a conventional exhaust tail pipe 1 is provided with a tail pipe finisher 2 for merely decorative purpose. Accordingly, when the engine is in operation, exhaust gas from the engine is discharged from the exhaust tail pipe to ambient air without any noise reduction treatment at the end section of the exhaust tail pipe.

Therefore, the following drawbacks are encountered in the conventional exhaust tail pipe arrangement: A boundary layer of exhaust gas from the engine is formed and grown on the inner surface of the exhaust tail pipe. The thus grown boundary layer separates from the exhaust tail pipe inner surface in the vicinity of the extreme open end of the exhaust tail pipe 1, thereby generating a turbulent jet behind the tail pipe open end. This results in high frequency air flow or jet noise. In addition, substantial flow passage area for exhaust gas flow is reduced under the action of the above-mentioned grown boundary layer, and therefore exhaust gas flow rate is increased by an amount corresponding to the thus reduced flow passage area, thereby contributing to enlarging the jet noise generated in the vicinity of the exhaust tail pipe open end.

Figure 2:
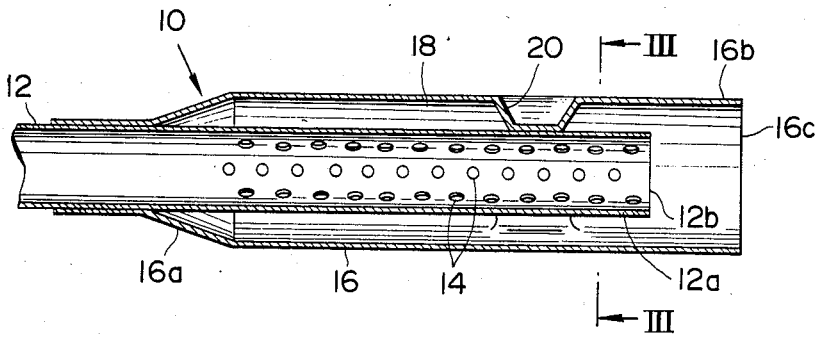
FIG. 2 is a longitudinal sectional view of an exhaust tail pipe arrangement in accordance with the present invention.
Figure 3:
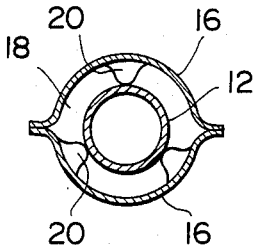
FIG. 3 is a vertical sectional view taken in the direction of arrows substantially along the line III—III of FIG. 2.

In view of the above description of the conventional exhaust tail pipe arrangement, reference is now made to FIGS. 2 and 3, wherein a preferred embodiment of an exhaust tail pipe arrangement of the present invention is illustrated by the reference numeral 10. The tail pipe arrangement forms part of an exhaust system of an internal combustion engine and comprises an exhaust tail pipe 12 which is extended from a muffler (not shown) to the rear end section of a vehicle body (not shown), for example, of an automotive vehicle. Exhaust gas from the internal combustion engine (not shown) of the automotive vehicle is introduced through the muffler to the exhaust tail pipe 12 to be discharged to ambient air and rearward of the vehicle body. The end section 12*a* of the exhaust tail pipe 12 has an extreme open end 12*b* from which exhaust gas is directly discharged to ambient air. A plurality of small annular perforations or openings 14 are formed in the end section 12*a* of the exhaust tail pipe 12. The inside and outside of the exhaust tail pipe 12 are communicated through the perforations 14 with each other.

An outer cover member 16 is securely disposed around the tail pipe end section with the perforations 14 in such a manner as to extend in the axial direction of the tail pipe end section 12*a*. The outer cover member 16 is constructed of a pair of semicylindrical counterparts which are joined each other by means of welding. The outer cover member 16 is formed tapered at its one or front end section 16*a* to be secured to the outer surface of the tail pipe 12 at a portion upstream of the end section 12*a* with the perforations, by means of welding, so that no clearance is made between the outer surface of the tail pipe 12 and the inner surface of the outer cover member front end section 16*a*. Preferably, the inner surface of the outer cover member front end section 16*a* sealingly contacts the outer surface of the tail pipe 12 so as to maintain fluid-tight seal therebetween. The other or rear end section 16*b* of the outer cover member 16 has an extreme open end 16*c* which is opened in the same direction as the tail pipe open end 12*b*. The outer cover member 16 is generally cylindrical except for the front end section 16*a* and coaxial with the tail pipe end section 12*a* in which the open end or extreme end opening 16*c* of the outer cover member 16 is coaxial with the open end or exhaust gas discharge opening 12*b*.

As shown, the outer cover member 16 is disposed spaced from the tail pipe end section 12*a* thereby to define an elongate annular space 18 between the inner surface of the outer cover member 16 and the outer surface of the tail pipe end section 12*a*. The annular space 18 is in communication with the inside of the tail pipe end section 12*a* and, of course, in communication with ambient air behind the end 16*c* of the outer cover member 16. The outer cover member 16 is formed at its central part with three projections 20 which are formed by deforming the cylindrical wall of the outer cover member 16, radially inward the three projections 20 being secured onto the outer surface of the tail pipe end section 12*a* by means of welding. It is to be noted that the extreme open end 16*c* of the outer cover member 16 is extended rearward over the extreme end 12*b* of the tail pipe end section 12*a* within a range where the extreme open end 16*c* of the outer cover member 16 does not interfere with spreading exhaust gas stream discharged from the extreme open end 12*b* of the tail pipe end section 12*a*.

The perforations 14 are uniformly distributed over whole the peripheral surface of the end section 12*a* of the tail pipe 12. Additionally, the diameter d (mm) of each perforation is within a range expressed by the following formula:

$$d \leqq \frac{4.4}{C} \times 10^3 \times \frac{A}{D^2}$$

where

A (l) = the displacement of an engine to which the tail pipe 12 is fluidly connected;

D (mm) = the inner diameter of the tail pipe 12; and

C = the kind of stroke cycle of the engine ("4" for a four-stroke cycle engine; and "2" for a two-stroke cycle engine).

Accordingly, in case of a four-stroke cycle engine, $$d \leqq 1.1 \times 10^3 \frac{A}{D^2}$$

In case of a two-stroke cycle engine, $$d \leqq 2.2 \times 10^3 \frac{A}{D^2}$$

With the above-discussed tail pipe arrangement 10, exhaust gas flowing along the inner surface of the tail pipe end section 12*a*, i.e., low energy exhaust gas within the boundary layer of exhaust gas flow is dissipated through the perforations 14 from the inside of tail pipe end section 12*a* into the space 18, thus effectively suppressing the growth of the boundary layer. It is to be noted that a vacuum condition is established within the space 18 under the action of the jet of exhaust gas discharged from the open end 12*b* of the tail pipe end section 12*a*, so that the thus generated vacuum effectively acts on the perforations 14. Accordingly, sucking-out action of the exhaust gas inside the tail pipe end section 12*b* can be very smoothly accomplished. Thus, the boundary layer growth suppression results in reduction in jet noise caused by separation of the grown boundary layer from the inner surface of the tail pipe end section 12*a*. It will be understood that the flow passage area of exhaust gas passing through the tail pipe end section 12*a* is hardly narrowed because of the ungrown boundary layer. This effectively contributes to prevention of exhaust gas maximum flow rate increase, thus avoiding jet noise increase.

It may seem that there is an apprehension that airflow noise is newly caused by turbulence generated upon the fact that exhaust gas passes at high speeds through the surface of the perforations 14. However, it is to be noted that such air flow noise generation due to the turbulence can be effectively suppressed by setting the diameter d of each perforation within the range as discussed above.

Figure 4:
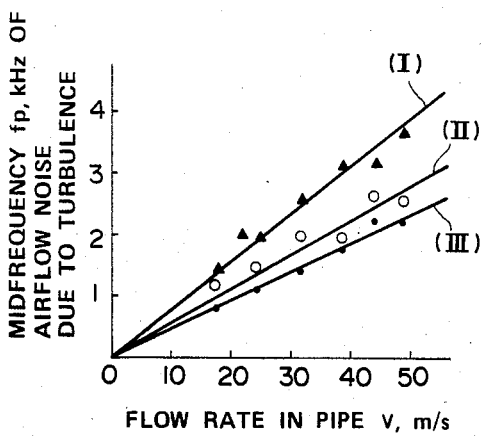
FIG. 4 is a graph showing the relationship between midfrequency of airflow noise due to turbulence caused by perforations of a pipe and exhaust gas flow rate in the pipe upon varied diameters of the perforations.
Figure 5:
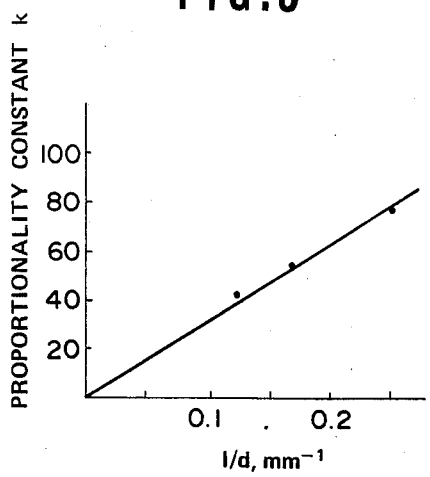
FIG. 5 is a graph showing the relationship between the proportionality constant determined from the FIG. 4 and the diameter of the perforations.

This will be discussed in detail hereinafter with reference to experimental data of FIGS. 4 and 5. Experiments revealed that, when exhaust gas was passed through a pipe formed with many small perforations, an approximately proportional relationship was established between the midfrequency $f_P$ (Hz) of air flow noise due to turbulence generated by the perforations and the flow rate v (m/s) within the pipe as shown in FIG. 4. In FIG. 4, a line III represents the case where the diameter of each perforation is 8 mm, a line II the case where the diameter of each perforation is 6 mm, and a line I the case where the diameter of each perforation is 4 mm. From FIG. 4, the proportionality constant k of the proportional relationship expressed by the equation $f_P = kv$ was determined. Upon this, the relationship between the proportionality constant k and the diameter d of each perforation was experimentally obtained as shown in FIG. 5. As seen from FIG. 5, the above-mentioned proportionality constant k and the reciprocal of the diameter d of each perforation are in proportional relationship, so that the proportionality constant k is expressed by the formula $$k = 0.32 \times 10^3 \frac{1}{d}.$$

This leads to the fact that the frequency $f_P$ is experimentally expressed by the equation $$f_P = 0.32 \times 10^3 \frac{v}{d}.$$

Now, in general, in a high engine speed operating range where engine speed is not lower than 3,000 rpm, airflow noise including jet noise becomes predominant in exhaust noise. Pulsation noise is predominent at a low engine speed operating range where engine speed is lower than 3,000 rpm so that air flow noise is negligible and therefore provides no problem. Additionally, the upper limit of human audible range is about 20 KHz. Therefore, it will be understood that a sharp exhaust noise reduction can be achieved by so controlling exhaust noise that the frequency $f_P$ of the noise due to the turbulence becomes 20 KHz or higher in the high engine speed operating range where engine speed is higher than 3,000 rpm.

In this connection, the exhaust gas flow rate v during engine operation at an engine speed of 3,000 rpm is expressed by the following formula on the assumption that the engine is of four-stroke cycle type, the exhaust temperature in the end section of an exhaust pipe during engine operation at the engine speed of 3,000 rpm is 500° C., and the volumetric efficiency for intake air of the engine is 0.8:

$$v = \frac{A \times 10^{-3} \times 3000 \times \frac{1}{2} \times \frac{1}{60} \times 0.8 \times \frac{273 + 500}{273 + 20}}{\frac{\pi}{4}(D \times 10^{-3})^2}$$

where

A (l) = the displacement of the engine; and

D (mm) = the inner diameter of the exhaust pipe.

Accordingly, from the above, the condition under which the frequency $f_P$ is $f_P \geqq 20{,}000$ is determined as $$d \leqq 1.1 \times 10^3 \frac{A}{D^2}.$$

It will be understood that, in case the diameter of each perforation meets this condition, the airflow noise due to the perforations becomes out of the audible range in the high speed engine operating range where engine speed is not lower than 3,000 rpm; in other words, the air flow noise is no longer offensive to human ear so as not to be serve as substantial noise.

Figure 6:
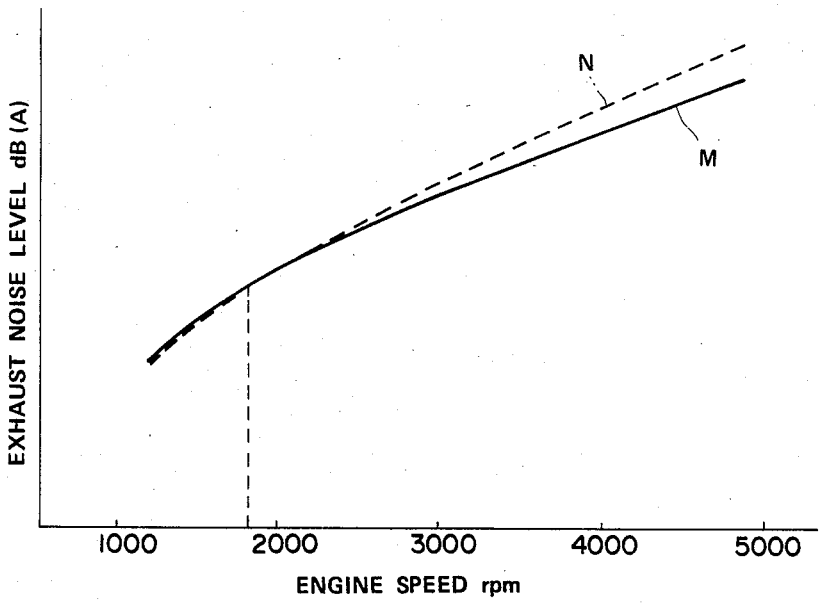
FIG. 6 is a graph showing the comparison in exhaust noise level between the conventional exhaust tail pipe arrangement and the exhaust tail pipe arrangement of the present invention.
Figure 7:
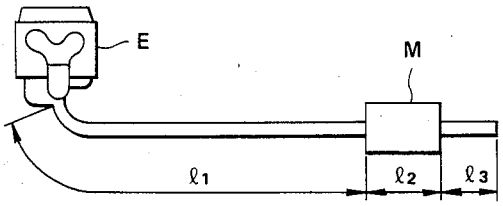
FIG. 7 is a schematic illustration showing a test apparatus used for measuring the data of FIG. 6.
Figure 8:
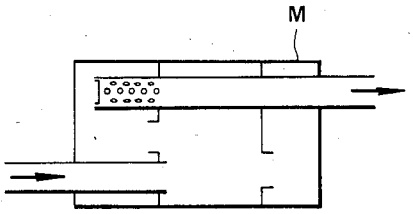
FIG. 8 is a schematic illustration showing a test apparatus used for measuring the data of FIG. 6.

FIG. 6 shows the comparison in exhaust noise level (measured by a sound level meter with "A" weighting) between the exhaust tail pipe arrangement of the embodiment of FIGS. 2 and 3 and the conventional exhaust tail pipe arrangement of FIG. 1, in which a solid line M indicates the former tail pipe arrangement of the present invention while a broken line N indicates the latter conventional tail pipe arrangement. The data of FIG. 6 were obtained by a test conducted with a test apparatus (as shown in FIG. 7) including an internal combustion engine E under the condition in which the displacement A of the engine is 1.8 (l); the inner diameter D of an exhaust pipe is 39.5 (mm); and an exhaust system (as shown in FIG. 7) has such a dimension that the length $l_1$ of a main exhaust pipe is 3560 mm, the length $l_2$ of an main muffler M is 340 mm, and the length $l_3$ of a tail pipe is 300 mm, the main muffler M being of the type shown in FIG. 8. Additionally, the diameter d of each perforation of the tail pipe end section is 0.75 mm which is within the range of the present invention, and the porosity of the perforations is 16%. The measurement of the exhaust noise level was made on full load engine operation. It will be appreciated that FIG. 6 reveals that the exhaust tail pipe arrangement of the embodiment of the present invention exhibited a sharp exhaust noise level lowering in the high engine speed operating range where air flow noise was predominant, as compared with the conventional exhaust tail pipe arrangement.

It will be understood that the tail pipe arrangement of the present invention may be applied to two-stroke cycle engines, in which the exhaust gas flow rate v (at the same engine speed) of the engines is approximately two times that in four-stroke cycle engines, and therefore a sharp exhaust noise reduction effect can be obtained by setting the diameter d of each perforation 14 within the range of $$d \leqq 2.2 \times 10^3 \frac{A}{D^2}$$

as discussed above.

As will be appreciated from the above, according to the exhaust tail pipe arrangement of the present invention, the growth of the boundary layer of exhaust gas flow is effectively suppressed under the action of the perforations formed in the tail pipe end section, thereby sharply reducing air flow noise due to separation of the boundary layer and jet noise due to substantial flow passage area reduction. In addition, even air flow noise generation due to the perforations can be prevented upon the diameter of each perforation being set within a predetermined range, thus achieving a sharp reduction for total exhaust noise.

What is claimed is:

1. An exhaust tail pipe arrangement comprising:

an exhaust tail pipe having an end section through which exhaust gas from an engine is discharged to ambient air;

an outer cover member disposed around said tail pipe end section in a manner to form a space between it and said exhaust tail pipe end section; and means defining a plurality of perforations in said exhaust tail pipe end section, each perforation establishing communication between the inside of said tail pipe end section and said space, each perforation having a diameter d (mm) within a range expressed by the following formula:

$$d \leqq \frac{4.4}{C} \times 10^3 \frac{A}{D^2}$$

where

A (l) = displacement of the engine;

D (mm) = inner diameter of said exhaust tail pipe end section; and

C = kind of stroke cycle of the engine ("4" for a four-stroke cycle engine; and "2" for a two-stroke cycle engine).

2. An exhaust tail pipe arrangement as claimed in claim 1, wherein said outer cover member is generally cylindrical and extends in the axial direction of said tail pipe end section so that said space is an elongate annular space formed between inner peripheral surface of said outer cover member and outer peripheral surface of said tail pipe end section.

3. An exhaust tail pipe arrangement as claimed in claim 2, wherein said outer cover member is securely connected at a first end to said tail pipe upstream of said end section with said perforations, and is opened at a second end to ambient air.

4. An exhaust tail pipe arrangement as claimed in claim 3, wherein the second end of said outer cover member extends over an open end of said tail pipe end section within a range in which interference with the exhaust gas discharged from said open end is avoided.

5. An exhaust tail pipe arrangement as claimed in claim 4, wherein the first end of said outer cover member is sealingly secured to the outer peripheral surface of said tail pipe so that a first end section of said space defined by said outer cover member first end is closed to maintain fluid-tight seal.

6. An exhaust tail pipe arrangement as claimed in claim 5, said perforations are uniformly distributed over whole the peripheral surface of said tail pipe end section.

7. An exhaust tail pipe arrangement as claimed in claim 6, wherein porosity of said perforations in said tail pipe end section is 16%.

8. An exhaust tail pipe arrangement comprising:

an exhaust tail pipe having an end section through which exhaust gas from an engine is discharged to ambient air;

an outer cover member disposed around said tail pipe end section in a manner to form a space between it and said exhaust tail pipe end section; and a plurality of perforations formed in said exhaust tail pipe end section, each perforation establishing communication between the inside of said tail pipe end section and said space, wherein said perforations are substantially circular in shape and have a diameter which is a function of the displacement of the engine from said exhaust tail pipe, the diameter of said exhaust tail pipe, and the stroke cycle of the engine.

9. An exhaust tail pipe as claimed in claim 8, wherein the diameter of said perforations is chosen so as to yield air flow noise having a midfrequency above the human audible range.

* * * * *